United States Patent [19]

Setsuie et al.

[11] 4,025,279

[45] May 24, 1977

[54] APPARATUS FOR PRODUCTION OF COMPOSITE STRUCTURE FIBERS

[75] Inventors: Takashi Setsuie; Yoshikazu Fujinaga; Koji Mimura, all of Ohtake, Japan

[73] Assignee: Mitsubishi Rayon Co., Ltd., Tokyo, Japan

[22] Filed: Jan. 13, 1976

[21] Appl. No.: 648,727

[30] Foreign Application Priority Data

Jan. 21, 1975 Japan ..... 50-9103

[52] U.S. Cl. ..... 425/463

[51] Int. Cl.[2] ..... D01D 5/28

[58] Field of Search ..... 425/131.5, 462, 463; 264/171

[56] References Cited

UNITED STATES PATENTS 3,245,113 4/1966 Sulich ..... 425/463

FOREIGN PATENTS OR APPLICATIONS 1,171,600 11/1969 United Kingdom ..... 425/131.5

*Primary Examiner*—Robert D. Baldwin

*Attorney, Agent, or Firm*—Oblon, Fisher, Spivak, McClelland & Maier

[57] ABSTRACT

An apparatus for producing composite structure fibers is disclosed which includes an upper distribution plate provided with plural slits for making at least two spinning components into independent thin layer streams, a lower distribution plate provided with plural fine holes for dividing each of said thin layer streams into plural fine capillary streams independent from each other and a spinneret plate provided with a bundling space and extrusion orifices for bundling said previously divided fine capillary streams and extruding them into filaments, said upper distribution plate, lower distribution plate and spinneret plate being piled up in this order.

1 Claim, 3 Drawing Figures

APPARATUS FOR PRODUCTION OF COMPOSITE STRUCTURE FIBERS

BACKGROUND OF THE INVENTION

The present invention relates to apparatus for producing the so-called composite structure fibers in the improved manner in which at least one spinning component is highly dispersed in another component and said dispersed spinning components continues in longitudinal direction of the fibers.

It was discribed, for example, in Japanese Patent Publication No. 7411/68 the method for spinning directly such composite structure fibers. However, very complicated apparatus is required in such method, if one tries to spin the composite structure fibers and since it is especially so difficult to design the distribution plate provided with many holes in high density, that orifice density of spinneret cannot be increased and so producibility per spinneret is extremely low. Moreover, handling of such apparatus is troublesome and especially adjustment of the apparatus after using is not simple.

The inventors have made intensive researches in an attempt to develop an industrially useful apparatus for producing composite structure fibers. So the object of the present invention is to provide apparatus which has no defects as seen in the conventional apparatuses, which increases producibility per spinneret, which is small-sized and which is simplified in its handling.

SUMMARY OF THE INVENTION

The gist of the present invention resides in an apparatus for producing composite structure fibers, where at least one spinning component is highly dispersed in another component. This apparatus is characterized in that an upper distribution plate provided with plural slit cavities for making at least two spinning components into thin layer streams which are independent from each other, a lower distribution plate provided with plural fine holes for dividing said thin layer streams into plural fine capillary streams which are independent from each other, and a spinneret plate provided with a bundling space and extrusion orifices for bundling previously divided fine capillary streams and extruding them into filaments are laminated in this order.

DETAILED DESCRIPTION OF THE INVENTION

Figure 1:
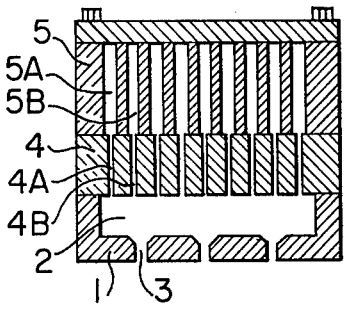
FIG. 1 is a vertical cross-sectional side view of one form of the apparatus according to the present invention.

The present invention will be explained in more detail referring to the drawings.

Figure 2:
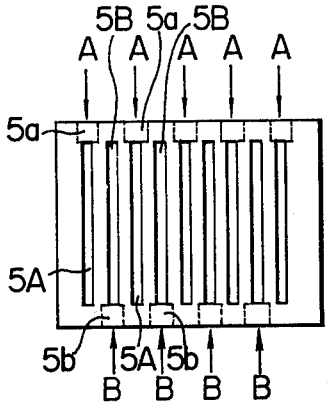
FIG. 2 is a plan-view of upper distribution plate in the apparatus shown in FIG. 1.
Figure 3:
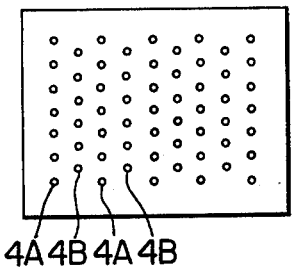
FIG. 3 is a plan-view of lower distribution plate in the apparatus shown in FIG. 1.

FIG. 1 is a vertical cross-sectional side view of one form of the apparatus according to the present invention and FIGS. 2 and 3 are plan-views of the lower and upper distribution plates in the apparatus shown in FIG. 1, respectively. In these FIGS. 1 to 3, 1 shows a spinneret plate, 2 shows a bundling space, 3 shows extrusion orifices, 4 shows a lower distribution plate and 5 shows an upper distribution plate.

The upper distribution plate 5 has many slit cavities 5A and 5B arranged alternately for making two spinning components A and B into independent thin layer streams, respectively and furthermore it has supply channel **5*a* which is in communication with slit cavity 5A and supply channel 5*b* which is in communication with slit cavity 5B, excavated in the side wall of the upper distribution plate 5**.

The lower distribution plate 4 has many fine holes 4A which is in communication with slit cavities 5A and many fine holes 4B which is in communication with slit cavities 5B.

In such apparatus, spinning component A and another spinning component B which are independently supplied into slit cavities 5A and 5B from supply channels **5*a* and 5*b*, are made into thin layer streams respectively. Each thin layer stream thus formed is divided into many independent fine capillary streams by fine holes 4A and 4B of the distribution plate 4, then all of said fine capillary streams are integrally bundled in the bundling space 2 of spinneret plate 1 and thereafter are extruded from extrusion orifices 3** as plural composite structure fibers.

According to the apparatus of the present invention constructed as mentioned above, fine holes 4A and 4B of the lower distribution plate 4 can be distributed in extremely great number in correspondence to slit cavities 5A and 5B of the upper distribution plate 5. Therefore, it is possible to extremely increase the producibility per spinneret by increasing the number of extrusion orifices 3 of the spinneret plate 1. Furthermore, since the upper distribution plate 5 and the lower distribution plate 4 are much simpler than conventional apparatuses in their construction, preparation and handling of the apparatus of the present invention are very easy and moreover the apparatus can be greatly small-sized.

In the above Example, a means according to which the spinning components A and B are supplied from the supply channel in the side part of the upper distribution plate is shown as a means for supplying independently the spinning components A and B into the slit cavities 5A and 5B, but any other means may be employed so long as they can independently supply the components A and B.

It is needless to say that the apparatus of the present invention can be applied to any of melt-spinning, dry-spinning and wet-spinning, and not only to the production of composite structure fibers comprising two spinning components, but to the production of composite structure fibers comprising three or more spinning components and that the extrusion orifices 3 may have any shapes which have been already known.

What is claimed is:

1. An apparatus for spinning composite structure fibers by highly distributing at least one spinning component in another spinning component, comprising:

an upper distribution plate provided with a plurality of slit cavities for making at least two spinning components into thin layer streams which are independent from each other;

a lower distribution plate provided with a plurality of fine holes in vertical alignment with said cavities for dividing each of said thin layer streams into a plurality of fine capillary streams which are independent from each other; and a spinneret plate provided with a bundling space in mutual communication with all of said holes for integrally bundling all of said divided fine capillary streams and extrusion orifices for extruding said bundled streams into filaments, the upper distribution plate, the lower distribution plate, and the spinneret plate being laminated in this order.

* * * * *